US005611456A

United States Patent [19]

Kasper

[11] Patent Number: 5,611,456

[45] Date of Patent: Mar. 18, 1997

[54] APPARATUS FOR DISPENSING TICKETS, CARDS AND THE LIKE

[75] Inventor: Kazmier J. Kasper, Hopkinton, Mass.

[73] Assignee: Algonquin Industries Inc., Bellingham, Mass.

[21] Appl. No.: 377,182

[22] Filed: Jan. 24, 1995

[51] Int. Cl.[6] ..... G07F 11/00

[52] U.S. Cl. ..... 221/154; 221/7; 221/129; 221/131; 221/213; 221/232; 221/195; 221/242; 221/258; 221/281; 271/18.3

[58] Field of Search ..... 221/194, 195, 221/198, 213, 215, 232, 242, 258, 274, 281, 282, 286, 131, 154, 279, 129; 271/18.3, 138

[56] References Cited

U.S. PATENT DOCUMENTS

| | | | |
|---|---|---|---|
| 1,459,504 | 6/1923 | Grover et al. | 221/195 |
| 2,263,040 | 11/1941 | Kaltenback | 221/213 |
| 3,228,553 | 1/1966 | Breitenstein et al. | 221/282 |
| 3,228,556 | 1/1966 | Nonestied | 221/279 |
| 3,282,466 | 11/1966 | Meresz et al. | 221/198 |
| 3,369,697 | 2/1968 | Glucksman et al. | 221/154 |
| 4,084,724 | 4/1978 | Christopherson et al. | 221/213 |
| 4,134,521 | 6/1979 | Pecht | 221/213 |
| 4,557,472 | 12/1985 | Hannon | 221/241 |
| 4,603,792 | 8/1986 | Molineux | 221/232 |
| 4,789,079 | 12/1988 | Kobayashi et al. | 221/232 |
| 5,137,173 | 8/1992 | Huges et al. | 221/154 |
| 5,197,629 | 3/1993 | Sanchez | 221/258 |
| 5,335,822 | 8/1994 | Kasper | 221/198 |

FOREIGN PATENT DOCUMENTS

| | | | |
|---|---|---|---|
| 380366 | 9/1932 | United Kingdom | 221/154 |

*Primary Examiner*—H. Grant Skaggs
*Attorney, Agent, or Firm*—Kriegsman & Kriegsman

[57] ABSTRACT

An apparatus for dispensing articles such as tickets and cards includes a cabinet and a plurality of article dispensing assemblies inside the cabinet. Each article dispensing assembly includes a base and a frame for enclosing articles to be dispensed in a stack. The bases are mounted on a pair of vertical support plates. Each frame is hingedly mounted on one of the support plates for movement between a dispensing position and a loading position, a removable partition wall disposed inside the frame whose position in the frame can be changed to accommodate articles of different sizes, a gate behind the frame for receiving articles from the frame and allowing only one article at a time to pass through, a toothed blade disposed underneath the frame, a motor driven rack and pinion coupled to the toothed blade for bringing the toothed blade into engagement with the lowermost article in the stack, moving said toothed blade so that the lowermost article is transported from the stack into the gate, bringing the toothed blade out of engagement with the article and then moving the toothed blade back to engage the next article in the stack, a removable weight seated on top of the stack to push the stack down against the toothed blade, a first sensor assembly for sending out a signal each time an article passes through the gate, second and third sensor assemblies for sending out signals for controlling movement of the motor coupled to the rack and pinion and a fourth sensor assembly for sending out a signal when there are no articles in the frame. A plurality of exit rollers are located behind the gates for pulling tickets out of the gates of the respective dispensing assemblies. An angled tray receives articles emerging from the exit rollers and directs the articles forward to an opening in the front of the cabinet for removal.

10 Claims, 10 Drawing Sheets

APPARATUS FOR DISPENSING TICKETS, CARDS AND THE LIKE

BACKGROUND OF THE INVENTION

The present invention relates generally to an apparatus for dispensing articles and more particularly to an apparatus for dispensing articles such as tickets, cards and the like. The invention is particularly suited for use with regard to dispensing pull-tab type lottery tickets; however, it is to be understood that the invention is not exclusively limited to dispensing pull-tab type lottery tickets, but rather may be used with dispensing other types of tickets as well as other types of articles such as cards and the like.

In U.S. Pat. No. 3,790,161 to K. E. Ericsson there is disclosed an apparatus for feeding sheets, cards, banknotes and the like from a stack, the apparatus comprising a rotary roll which engages the lowermost sheet, card or banknote in the stack, a further roll spaced from the and preferably slightly above the first roll, and a strip having a rough coating and so arranged between the two rolls as to extend inside a plane tangent to the peripheries of the rolls.

In U.S. Pat. No. 5,018,614 to W. D. K. Ruckert there is disclosed a ticket vending machine wherein an outer housing encloses an inner panel separating a money accepting and ticket dispensing apparatus. The money accepting apparatus releases an internal lever upon insertion of the correct money. This internal lever disengages from a toothed plate which is connected by a shaft to an external hand lever. A pulling of the external hand lever after insertion of the correct money turns multiple gears which cause a cam to actuate to release a ticket retaining gate. In addition, the gears are connected to a cylindrical rear roller which turns a pair of latex bands mounted around the rear roller and a front cylindrical roller mounted on an idler shaft. A weight over the tickets causes frictional pressure to be exerted on the ticket by turning bands and thereby allows the bands to move a single ticket under a raised exit gate.

In another known type of apparatus for dispensing tickets, the tickets are disposed in a stack and are moved from the stack into a gate by a rotably mounted toothed wheel located underneath the stack.

In U.S. Pat. No. 4,704,518 to F. A. Brumm et al there is disclosed an apparatus for printing and issuing tickets which has a circular ticket guide in which a drive cylinder is disposed to selectively rotate in a forward or reverse direction. A ticket magazine feeds a blank ticket into the ticket guide in the forward direction and the cylinder rotates, driving the ticket in the forward or reverse direction in order to execute a series of process steps involved in issuing the written ticket. The tickets are stacked in the magazine obliquely on edge and retained in a pack configuration at the lower end of the magazine by a gravity actuated ticket retainer. Arrayed in an arcuate sequence adjacent the ticket guide in the forward direction are a printing and reading apparatus, a ramped impound aperture, and a ramped issue aperture. A ticket is fed from the hopper in the forward direction and the drive cylinder is rotated to carry the ticket past the printing and reading apparatus where information is written and verified on the ticket. The drive cylinder continues to rotate in the forward direction, carrying the ticket pass the impound, and then the issue aperture. The drive cylinder then reverses, first offering the ticket through the issue aperture and then, if the ticket is not manually removed from the aperture, the drive cylinder is rotated to feed the ticket into an impound enclosure through the impound aperture.

In U.S. Pat. No. 4,716,799 to D. Hartmann there is disclosed an automatic ticket dispensing machine and a method for operating it to automatically adjust itself to the size of tickets being dispensed. A strip of tickets is fed forward with an advancing mechanism past an optical sensor which detects the perforations between tickets. The optical sensor is coupled to a controller which controls the advancing mechanism. The controller determines the length of the ticket by monitoring the distance the tickets are advanced between detections of perforations. In response to a request for a ticket, the controller advances the ticket strip by a distance corresponding to the predetermined ticket length of output.

In U.S. Pat. 4,982,337 to Burr et al there is disclosed a system and method for distributing lottery tickets which includes a large number of remote, ticket-dispensing units which are connected intermittently, e.g., once each day or week to a central computer. The units record the number of tickets sold and transmit the sales data to the central computer, which in turn performs all the necessary accounting functions. Sales reports and invoice data may be sent by the central computer to each unit for printing, which avoids the need to mail the reports/invoices. The tickets are stored in fan-fold form and are burst, rather than cut, apart for dispensing. The tickets are dispensed at one end of the unit which faces the customer. A control panel for the vendor is located at the opposite end. Tickets of different length may be dispensed with an imprint of the vendor's name.

In U.S. Pat. 5,335,822 to K. Z. Kasper is disclosed an apparatus for dispensing tickets from a stack. The apparatus includes a base. A frame for enclosing a stack of tickets is fixedly mounted on the base. A partition wall whose position can be changed to accommodate tickets of different sizes is removably mounted in the frame. A gate for receiving tickets and allowing only one ticket at a time to pass through is also fixedly mounted on the base. The gate includes a slider element which is adjusted to different heights by a screw having two different sized threads in order to accommodate tickets of different thickness. A toothed blade is disposed underneath the frame and a mechanism which includes a motor driven rack and pinion is coupled to the toothed blade for bringing the toothed blade into engagement with the lowermost ticket in the stack, moving said toothed blade so that the lowermost ticket is transported from the stack into the gate, bringing the toothed blade out of engagement with the ticket and then moving the toothed blade back to engage the next ticket in the stack. A removable weight is seated on top of the stack to push the stack down against the toothed blade. A ticket holder is provided to assist in loading tickets into the frame.

Other patents of interest include U.S. Pat. No. 2,078,984 to S. W. Williamson; U.S. Pat. No. 2,637,609 to P. Berg; and U.S. Pat. No. 5,176,237 to R. G. Yang.

It is an object of this invention to provide a new and improved apparatus for dispensing tickets, cards and the like.

It is another object of this invention to provide a new and improved apparatus for dispensing tickets, cards and the like from a stack.

SUMMARY OF THE INVENTION

An apparatus constructed according to this invention for dispensing articles such as tickets, cards and the like comprises a cabinet and an article dispensing module inside said cabinet, said article dispensing module comprising at least one article dispensing assembly, each article dispensing assembly including a base, a frame for enclosing a plurality of articles in a stack, one on top of the other, a gate for receiving articles from the stack and allowing only one article at a time to pass through and a transport mechanism for transporting articles from said frame to said gate. The article dispensing module also includes a pair of vertical support plates for supporting the base.

According to one feature of the invention, each frame in each article dispensing assembly is hingedly mounted on one of the support plates so that it can be moved from a vertical position where articles contained therein are dispensed to a non-vertical position where articles can be loaded into it easily from the top.

According to another feature of the invention, a locking mechanism is provided for each frame for releasably locking the frame in its vertical position.

According to still another feature of the invention, a removable weight is provided for exerting downward pressure on the stack, the weight including a handle having side portions arranged so as to slide within a pair of grooves formed in the sidewalls of the frame when the weight is seated in the frame on top of the stack so as to restrict sidewise and back and forth movement of the weight within the frame.

According to yet still another feature of the invention, exit rollers are provided to pull articles being dispensed from the gates.

According to another feature of the invention, the article dispensing module is positioned within the cabinet facing to the rear so that the articles being dispensed exit therefrom inside the cabinet at the rear, and then drop down into an angled tray where they slide down forward to an opening in the front of the cabinet. This arrangement prevents damaging the exit mechanism by reaching in and pulling articles out from the exit rollers or tampering with the exit mechanism in an unauthorized way to extract articles.

According to still another feature of the invention, sensor assemblies are provided for each dispensing assembly, one for sending out a signal used in counting articles dispensed, a pair for sending out signals for controlling movement of the transport mechanism, and a fourth for sending out a signal for indicating an empty condition in the frame. Each sensor assembly includes a flag and an optical sensor.

Various other features and advantages will appear from the description to follow. In the description, reference is made to the accompanying drawing which forms a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts:.

DETAILED DESCRIPTION OF THE PREFERRED EMBODIMENTS

Figure 1:
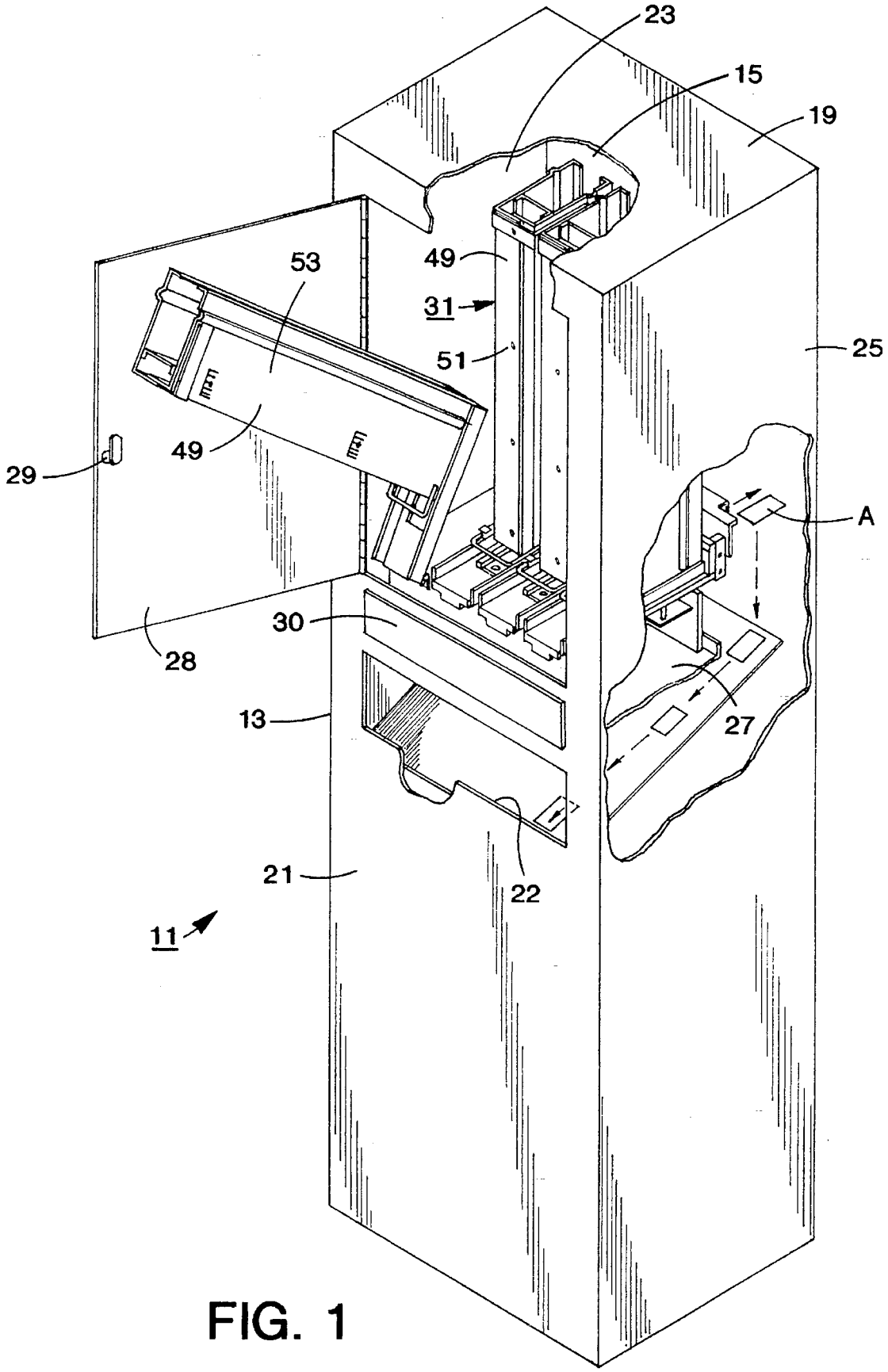
FIG. 1 is a perspective view taken from the front of an apparatus constructed according to this invention for dispensing articles with the door in the cabinet portion of the apparatus open and with one of the article dispensing assemblies in the article dispensing module inside the cabinet tilted forward for article loading purposes.
Figure 5:
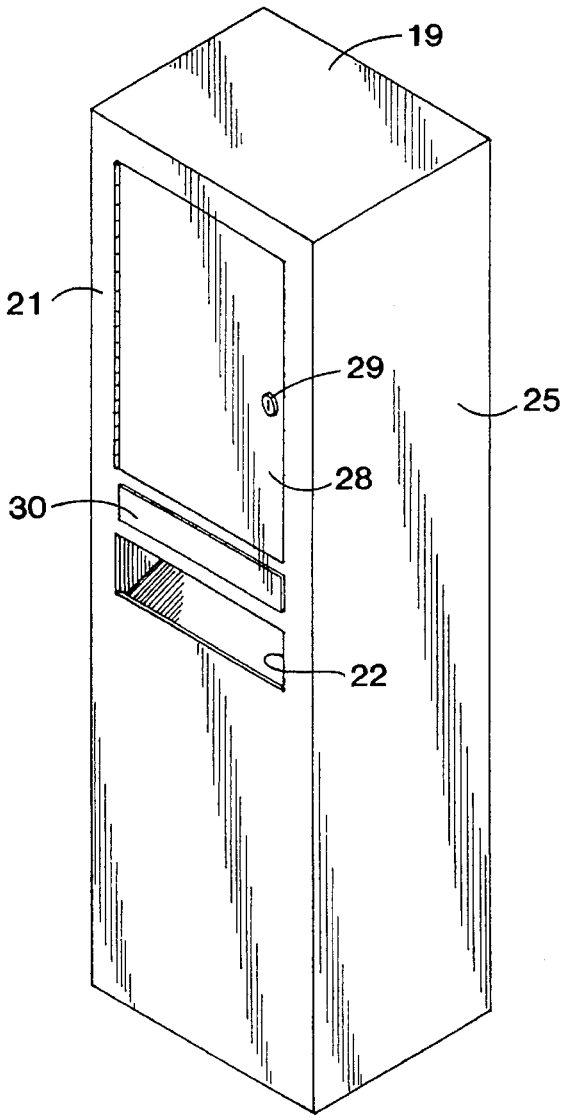
FIG. 5 is a perspective view taken from the front of the cabinet portion of the apparatus shown in FIG. 1, with the door closed.
Figure 2:
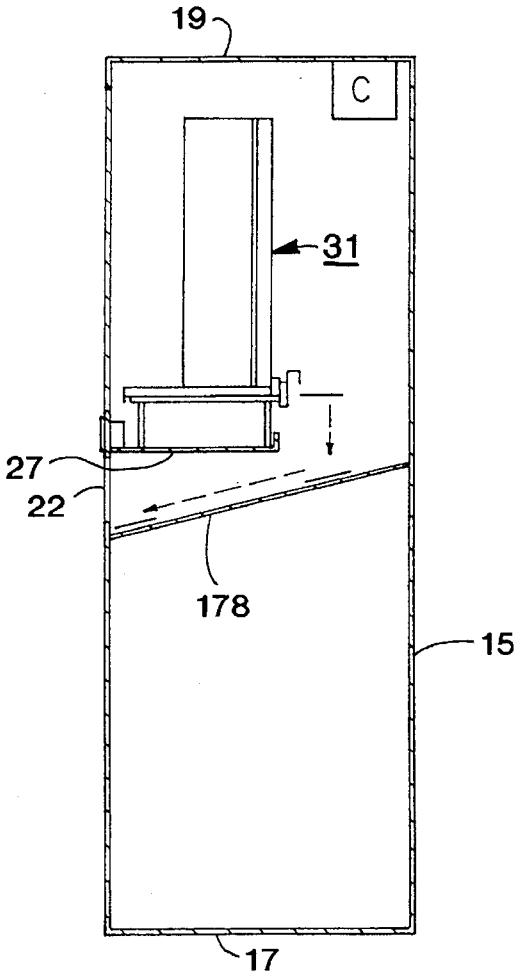
FIG. 2 is a side section view of the apparatus in FIG. 1, with the article dispensing module being shown in simplified form.
Figure 3:
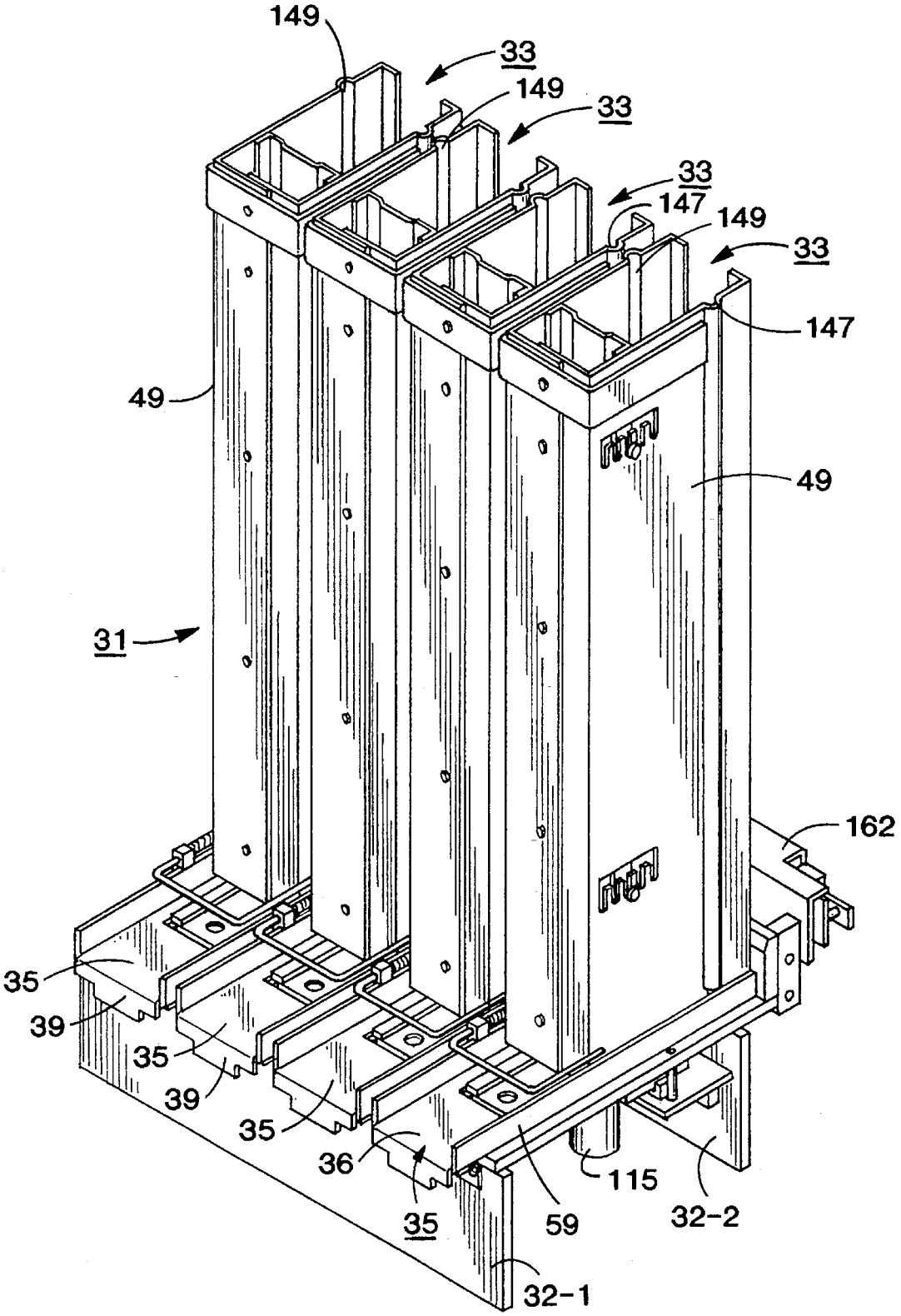
FIG. 3 is a perspective view taken from the front of the article dispensing module shown in FIG. 1.
Figure 4:
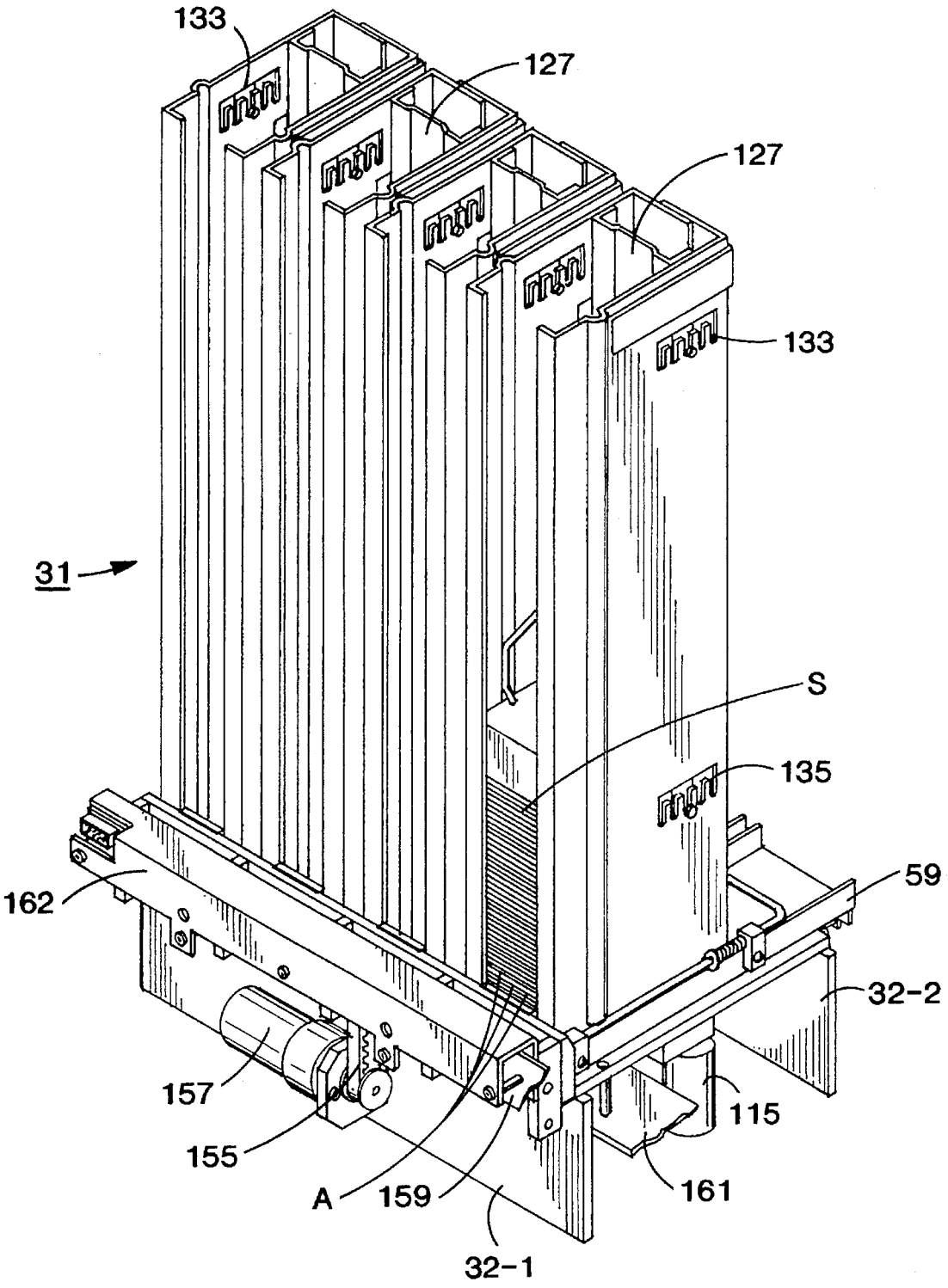
FIG. 4 is a perspective view taken from the front of the article dispensing module shown in FIG. 2.
Figure 6:
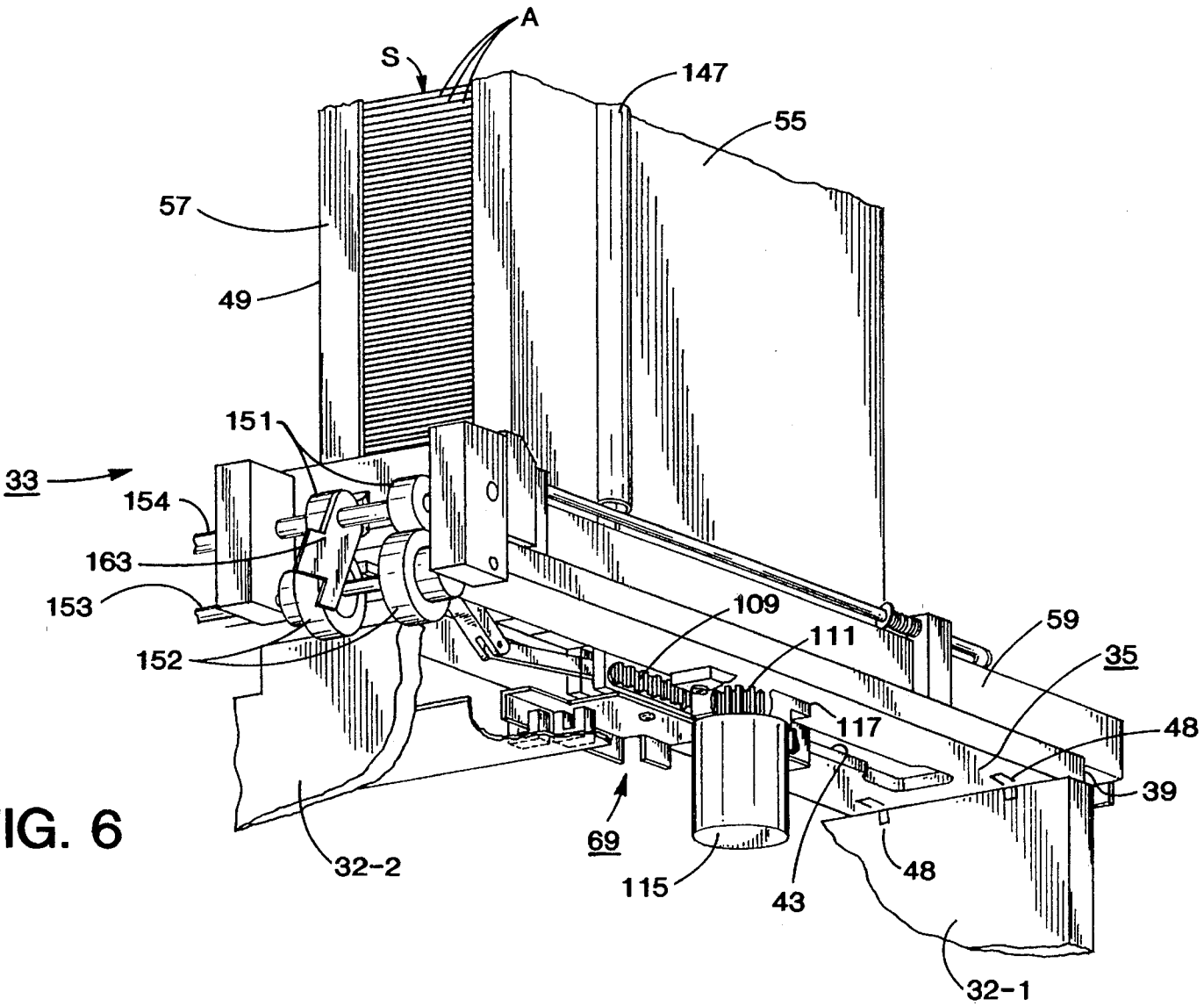
FIG. 6 is a fragmentary perspective view taken from the bottom and partly broken away of the article dispensing module shown in FIG. 1.
Figure 8:
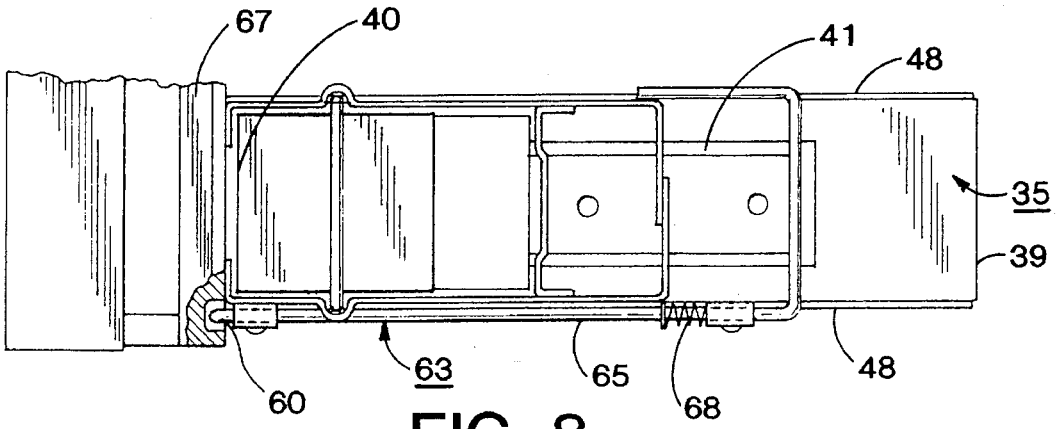
FIG. 8 is a fragmentary top view of the portion of the apparatus shown in FIG. 7.
Figure 7:
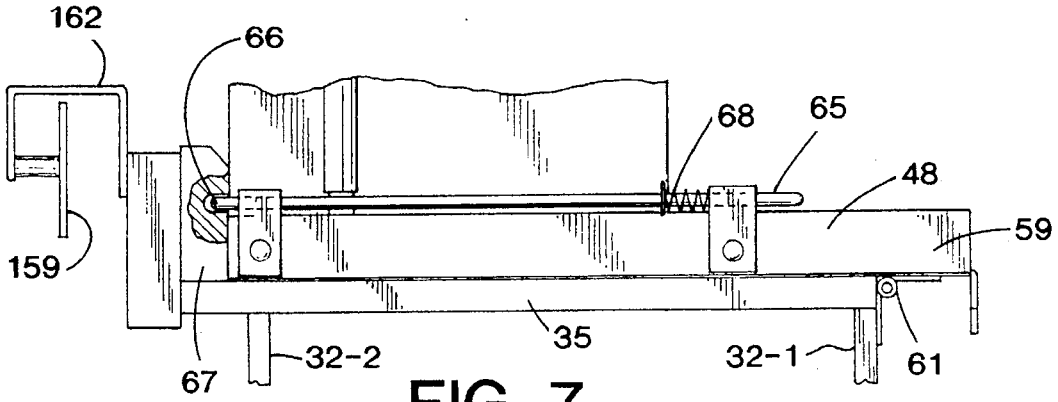
FIG. 7 is a fragmentary side view partly broken away showing one of the frames in the article dispensing module hingedly attached to its associated base and positioned vertically.
Figure 9:
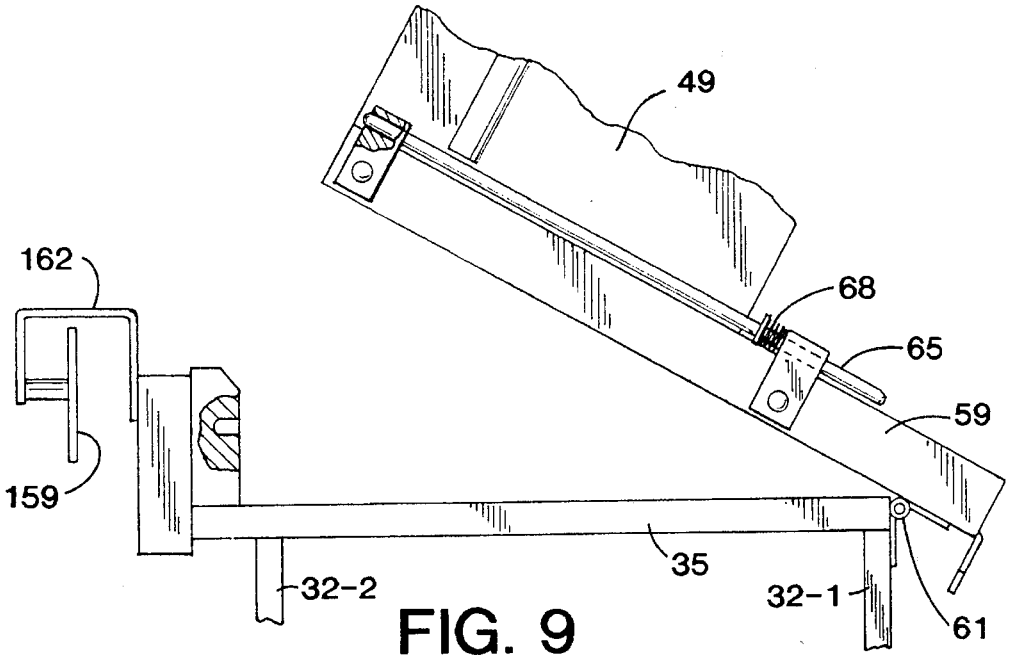
FIG. 9 is a fragmentary side view of the portion of the apparatus shown in FIG. 1, but with the frame tilted for loading purposes.
Figure 10:
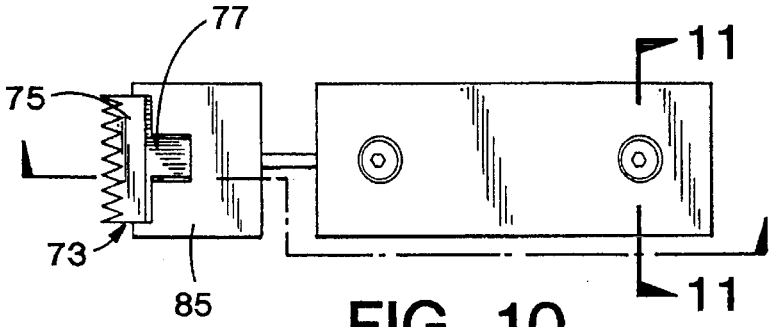
FIG. 10 is a top view of the two slider elements, toothed blade and linkage in the transport mechanism associated with each article dispensing assembly;.
Figure 11:
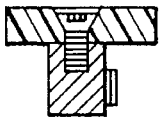
FIG. 11 is a section view taken along lines 11—11 in FIG. 10.
Figure 14:
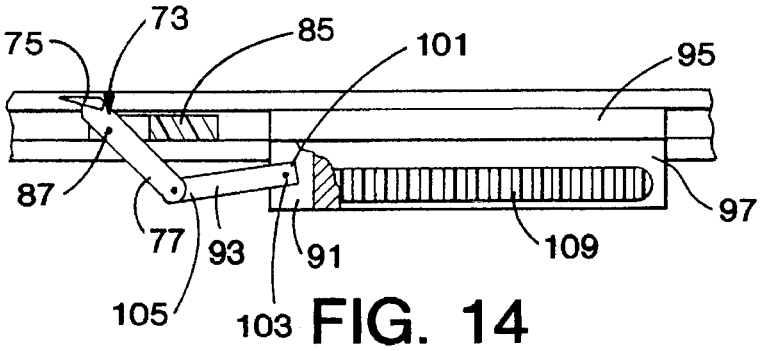
FIG. 14 is a fragmentary side section view showing the toothed base with the head of the toothed base in a horizontal position.
Figure 15:
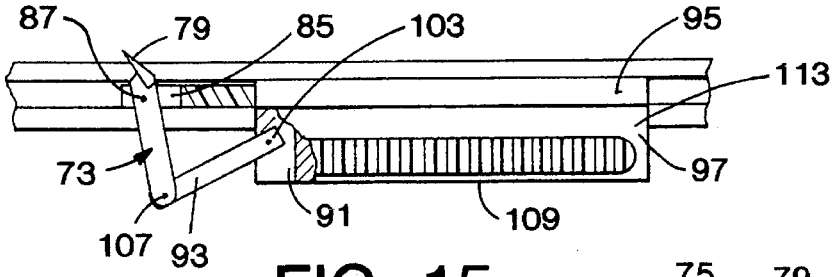
FIG. 15 is a fragmentary side section view showing the toothed blade with the head of the toothed blade angled up for engagement with an article.
Figure 12:
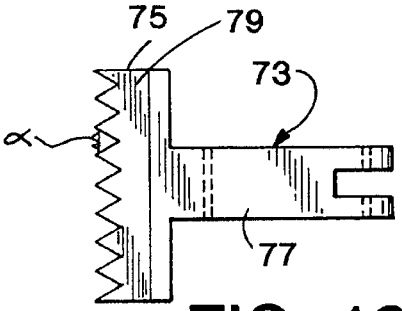
FIGS. 12 and 13 are top and side views, respectively of the toothed blade shown in FIG. 10.
Figure 16:
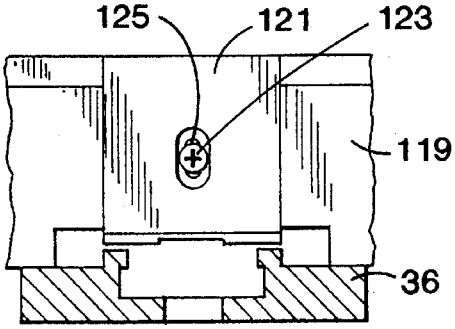
FIG. 16 is a fragmentary front view of the gate in one of the article dispensing assemblies.
Figure 13:
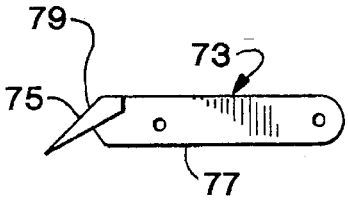
Figure 17:
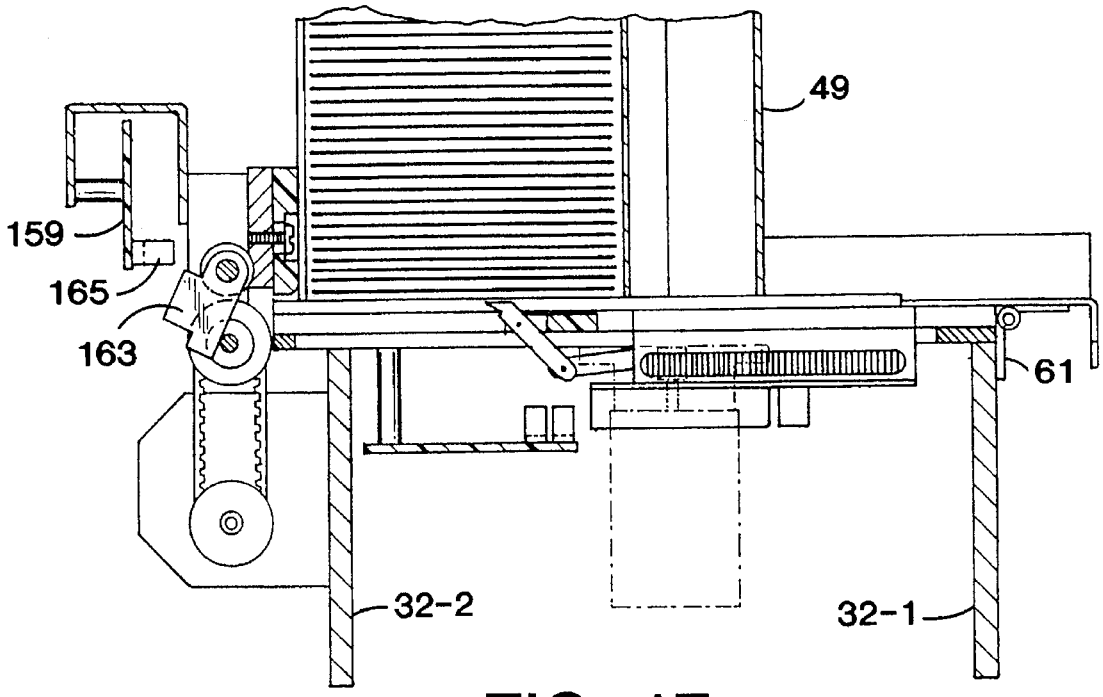
FIG. 17 is a fragmentary side section view of one of the article dispensing assemblies before the toothed blade is brought into engagement with an article.
Figure 18:
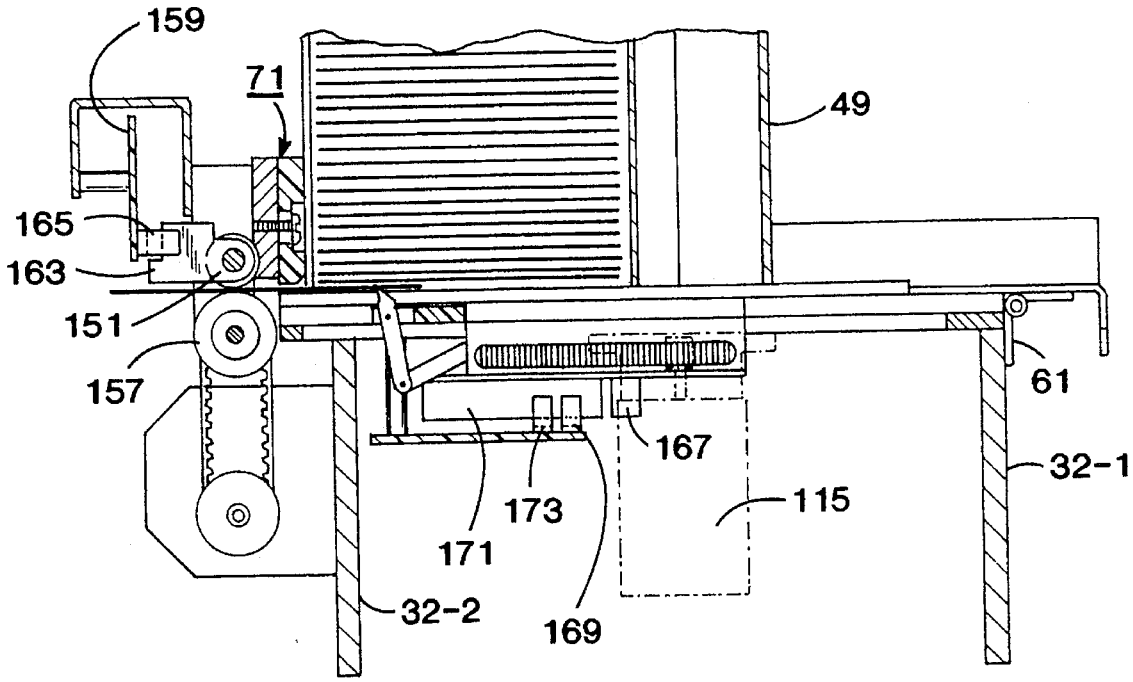
FIG. 18 is a fragmentary side section view of one of the article dispensing assemblies after the toothed blade is brought into engagement with an article.
Figure 20:
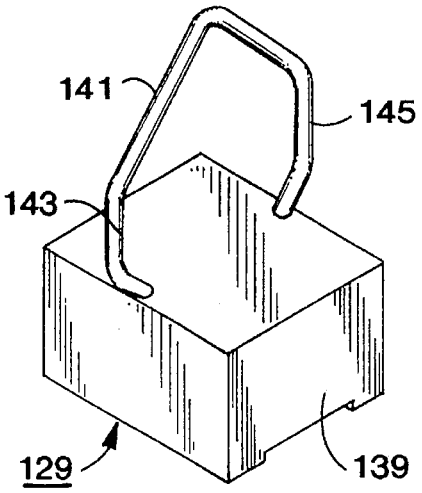
FIGS. 20 and 21 are front and bottom perspective views, respectively, of the weight shown in FIG. 4.
Figure 21:
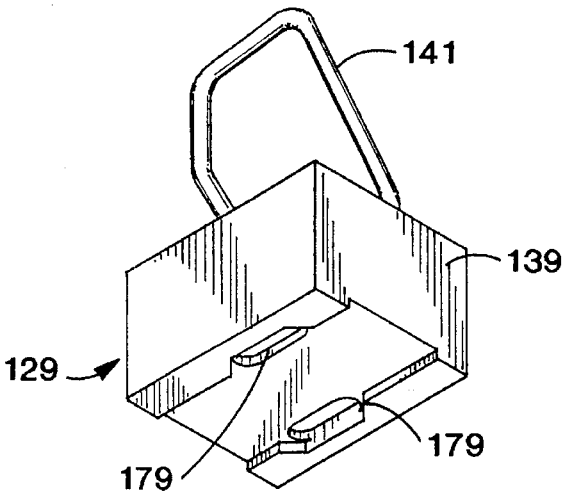
Figure 19:
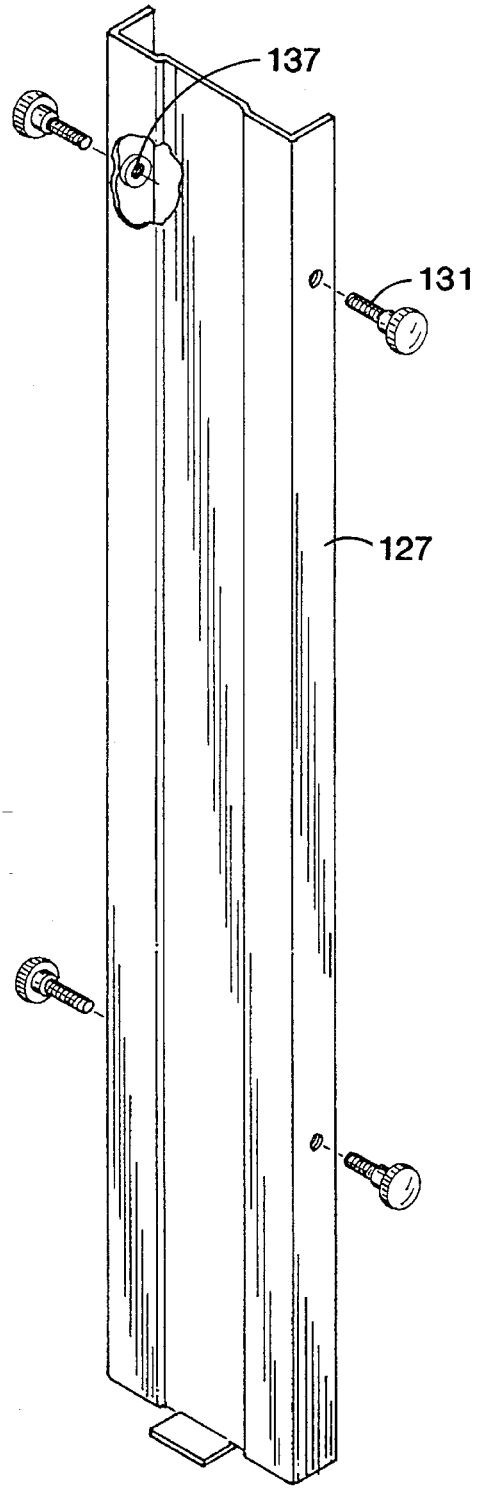
FIG. 19 is a perspective view of one of the partition walls shown in FIG. 3.
Figure 3A:
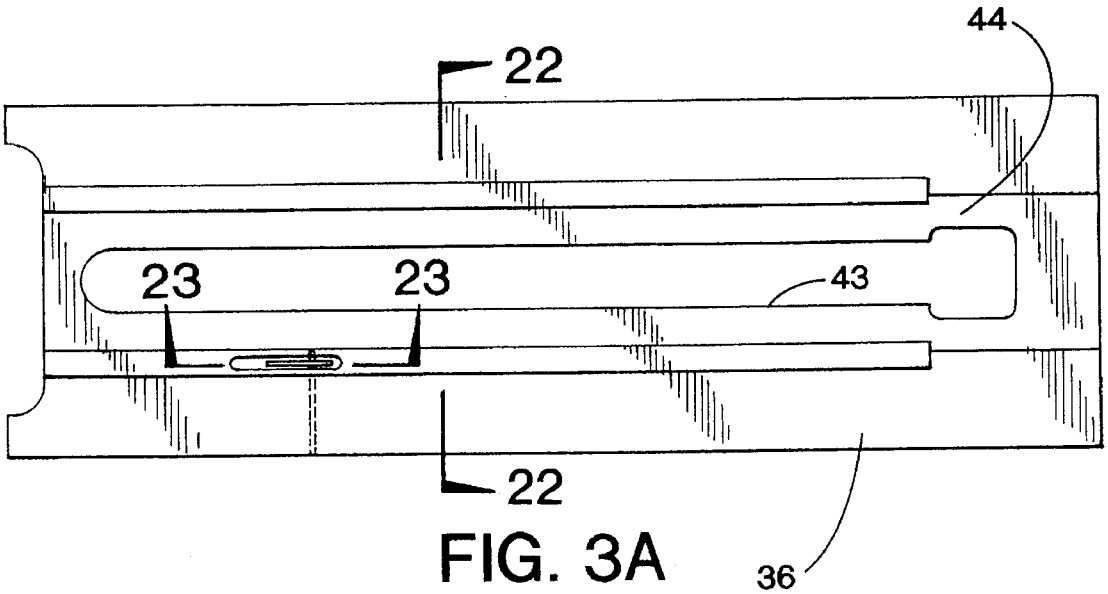
FIG. 3A is a plan view of one of the bases shown in FIG. 3.
Figure 22:
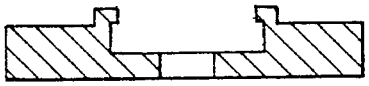
FIG. 22 is a section view taken along lines 22—22 in FIG. 3.
Figure 23:
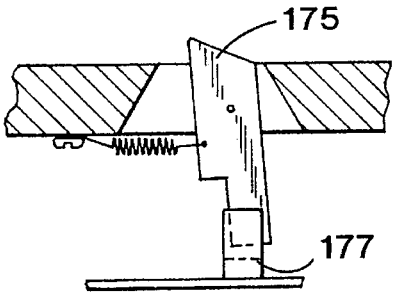
FIG. 23 is a section view taken along lines 23—23 in FIG. 3 with no tickets in the frame.
Figure 24:
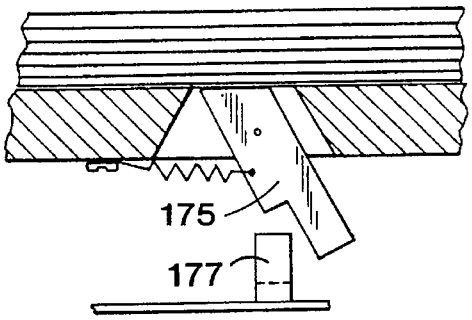
FIG. 24 is a section view similar to FIG. 23 but with articles to be dispensed in the frame.

Referring now to the drawings, and first to FIGS. 1 and 2, there is shown an apparatus constructed according to this invention for dispensing articles such as tickets and cards, the apparatus being identified by reference numeral 11. Portions of apparatus 11 not pertinent to the invention are not shown.

Apparatus 11 includes a generally rectangular cabinet 13 having a back wall 15, a bottom wall 17, a top wall 19, a front wall 21 having an opening 22 through which articles are dispensed, left and right side walls 23 and 25, respectively, and a shelf 27. Front wall 21 includes a door 28 which is hingedly mounted to provide access to the interior of cabinet 13. Door 28 normally maintained in a closed position by a lock 29. Shelf 27 is sized so that it does not extend back all the way to back wall 15 for a reason that will hereinafter became apparent. A control panel 30 having controls (not shown) for selecting the article to be dispensed from within apparatus and an opening (not shown) through which money is inserted is provided on front wall 21.

An article dispensing module 31 is disposed inside cabinet 13. Article dispensing module 31 includes a plurality of article dispensing assemblies 33 which are identical in construction, the number shown being for illustrative purposes only, and a pair of vertical support plates 32-1 and 32-2.

Each article dispensing assembly includes a generally rectangular base 35 having a front end 37, a rear end 39 and a longitudinally disposed rectangular recess 41 having an longitudinal opening 43. Bases 35 are fixedly secured by brackets 45 to support plates 32-1 and 32-2 which in turn are fixedly secured by brackets and bolts (not shown) to shelf 27.

Each article dispensing assembly 33 also includes an elongated frame 49 for enclosing a plurality of articles A to be dispensed in a stack S, one on top of the other. Articles A may be, for example, pull-tab type lottery tickets or plastic telephone credit cards or the like. Frame 49 is generally rectangularly shaped in cross section and includes a front wall 51, left and right side walls 53 and 55, respectively and a rear wall 57 that is open at the middle.

Frame 49 is fixedly mounted on a bracket assembly 59 which is pivotally attached to support 32-1 by a hinge 61. The pivotal attachment of frame 49 to support 32-1 allows frame 49 to be pivoted forward from a vertical position, which is the intended position it is in for dispensing articles A, to an angled position where articles A to be dispensed can be easily loaded into frame 49 from the top by a person standing in front of cabinet 13. A locking mechanism 63 is provided for releasably locking frame 49 in place in a vertical position. Locking mechanism 63 includes a U shaped rod 65 slidably mounted on bracket assembly 59 and having one end 60 adapted to slip into hole 66 on the back of a plate 67 attached-to base 35. A spring 68 is provided for urging rod 65 in a backward direction toward holes 66.

Each article dispensing assembly 33 further includes a transport mechanism 69 and a gate 71. Transport mechanism 69 is located below frame 49 and gate 71 is located behind frame 49. The purpose of transport mechanism 69 is to transport articles A from stack S into gate 71. The purpose of gate 71 is to receive articles A transported to it from frame 49 and allow only one article at a time to pass through.

Transport mechanism 69, includes a toothed blade 73 made of tool steel. Blade 73 is a unitary structure and includes a head portion 75 and a stem portion 77. Head portion 75 includes a top surface 79 and a front edge having teeth. The angle between adjacent teeth is preferably about 30 degrees. This angle enables the teeth to easily and security grip onto plastic as well as cardboard articles 81. Stem portion 77 is bifurcated at its lower end 83. Blade 73 is mounted for pivotal movement on a first slider element 85 by a pivot pin 87 which extends through a hole formed in slider element 85 and a hole formed in the stem 77 of toothed blade 73. First slider element 85 is generally rectangularly shaped and is mounted for slidable movement back and forth in recess 44 of horizontal base 35.

Toothed blade 73 is coupled to a second slider element 91 by an elongated link 93. Second slider element 91 includes an upper piece 95 and a lower piece 97 which are fixedly secured to each other by bolts (not shown). One end 101 of link 93 is pivotally attached to second slider element 91 by a pivot pin 103. The other end 105 of link 98 is pivotally attached to the bottom 107 of the stem portion 77 of toothed blade 73 by a pivot pin 107. Second slider element 91 is slidably mounted in recess 41 of base 35 behind first slider element 85 with piece 95 seated in recess 41 and piece 97 disposed underneath base 35. With the two sliders spaced apart top surface 79 of head 75 is horizontal. Movement of second slider element 9i in recess 41 in a rearward direction toward first slider element 85 will result in pivotal movement downward of link 93. This in turn will produce pivotal movement upward of head portion 75 of toothed blade 73 in first slider element 85. Head portion 75 will continue to pivot upward until second slider element 91 hits up against first slider element 85. At this time, top surface 79 is pivoted up about 10 degrees from the horizontal. When second slider 91 is moved in a forward direction head portion 75 will be pivoted back to a horizontal position. First and second slider elements 85 and 91, respectively, are made of a rigid plastic material, such as Delrin.

Second slider element 91 is moved back and forth in recess 41 by a rack 109 and pinion 111 combination. Rack 109 is press fit into a longitudinal recess formed in the side 113 of second slider element 91. Pinion 111 is driven by a vertically disposed reversible motor 115 which is fixedly mounted on base 35 by a bracket 117. Bracket 117 is fixed to base 35 by bolts. As can be seen, by having rack 111 on the side of element 91 and motor 115 extending vertically down, motor 115 does not extend out laterally beyond base 35. As a result, adjacent assemblies 33 can be disposed closely next to each other rather than having to be spaced apart because of the motors 115.

Gate 75 includes a support 119 and a slider element 121. Slider element 121 is slidably mounted for up and down movement on plate 67, the space between the bottom of slider 121 and base plate 36 serving as an opening through which an article A can pass. The height of the opening is controlled by raising or lowering slider 121. Slider 121 is fixed at a desired height by a screw 123 which extends through an oval shaped hole 125 in slider 121 into a threaded opening (not shown) in plate 67.

Each article dispensing assembly 33 further includes a U shaped partition wall 127 and a removable weight 129. Partition wall 127 is used to change the area inside frame 49 to snugly hold different sized articles A without having to disassemble frame 49 and replace it with a different sized frame. Partition wall 127 is mounted on frame 49 by bolts 131 which fit into notched recesses 133 and 135 on the sidewalls of frame 49 and are secured in place by nuts 137. Removable weight 129 is used to push stack S down within frame 49 so that toothed blade 73 will engage the lowermost article in stack S and move it by frictional engagement. Weight 129 comprises a block 139 of heavy material. A handle 141 is provided for holding block 139. Handle 141 is shaped to include a pair of side portion 143 and 145 which are shaped so as to slide within a pair of grooves 147 and 149 in the sides of frame 49. This limits movement of weight 129 in frame 49 to up and down so that it will always be centered properly in frame 49 directly above transport mechanism 69 regardless of the position of wall 127 within frame 49.

Article dispensing module 31 also includes two sets of exit rollers 151 and 152 for pulling articles A being dispensed out from gates 75. Rollers 151 and 152 are disposed behind gates 75. Rollers 152 are mounted on a shaft 153 which is coupled by a belt 155 to a drive motor 157.

Article dispensing module 31 also includes two printed circuit boards 159 and 161 for holding electronics for the module. Boars 159 is mounted on a bracket 162 attached to base 35. Board 151 is mounted on base 35.

Each article dispensing assembly 33 also includes a first sensor assembly for sending out a signal each time an article passes through the gate, second and third sensor assemblies for sending out signals for controlling movement of the motor coupled to the rack and pinion and a fourth sensor assembly for sending out a signal when there are no articles in the frame. First sensor assembly includes a flag 163 rotably mounted on shaft 154 and an optical sensor 165 on plate 159 fixed to support 38. Second sensor assembly includes a flag 167 on second slider and an optical sensor 169. Third sensor assembly includes a flag 171 and an optical sensor 173. Fourth optical sensor includes a flag 175 and an optical sensor 177.

Block 139 in weight 129 has a pair of holes 179 located so that when there are no articles A left in frame 49, weight 129 will not press down on flag 175.

Apparatus 11 also includes an angled tray 178 below shelf and a computer C for controlling the overall operation of apparatus. Computer C is coupled to boards 159 and 161 by cables (not shown).

In the operation of apparatus 11, articles A to be dispensed are first loaded into frames 49. Articles in each frame 49 need not be the same type of item. Articles are moved from frames 49 to their respective gates 71 by their respective transport mechanisms 69, on instructions from the computer, then ejected from gates 71 by exit rollers 151 where they drop down behind shelf 27 into tray 173 and then slide forward on tray to opening 22 in the front of cabinet 13 where they are picked up by the purchaser. Since gates 71 and exit rollers 151 and 152 are located inside cabinet 13 at the rear, tampering with the exit mechanism i.e. gates 71 and rollers 151 from the front is avoided.

The embodiment shown of the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. Apparatus for dispensing articles such as tickets, cards and the like comprising:

a. a cabinet having a front and a back, b. an article dispensing module inside said cabinet, said article dispensing module including at least one article dispensing assembly and support plate, each article dispensing assembly comprising:

i. a base, ii. a frame for enclosing a plurality of articles to be dispensed in a stack, iii. a hinge for hingedly mounting said frame onto said support plate for movement from a vertical position to a non-vertical position, iv. a gate for receiving articles from said frame and allowing only one article at a time to pass through, v. a transport mechanism underneath said frame for transporting articles form said frame to said gate, said transport mechanism comprising a toothed blade, a rack and pinion, a reversible motor, a first slider element slidably mounted on said base and a second slider element slidably mounted on said base, said toothed blade being pivotally mounted on said first slider element, said rack being fixedly mounted on said second slider element, said toothed blade being pivotally mounted to said second slider element by a linkage and said reversible motor being fixedly mounted on said base, and vi. a locking mechanism for locking the frame in a vertical position.

2. The apparatus of claim 1, wherein each dispensing assembly further includes a removable weight for exerting downward pressure on the stack of articles, said weight and said frame being constructed so that the weight will not move sideways or back and forth within the frame.

3. The apparatus of claim 1, wherein each article dispensing assembly further includes a bracket assembly and wherein said frame is fixedly mounted on said bracket assembly and wherein said bracket assembly is attached to said support plate by said hinge.

4. The apparatus of claim 3 wherein said locking mechanism includes a rod slidably mounted on said bracket assembly and a spring for urging said rod in one direction.

5. The apparatus of claim 4 wherein said rod is U shaped.

6. The apparatus of claim 5, wherein said frame has a pair of grooves and wherein a weight has a handle having side portions arranged to slide within said grooves.

7. Apparatus for dispensing articles such as tickets, cards and the like comprising:

a. a cabinet having a front and a back, b. an article dispensing module inside said cabinet, said article dispensing module including at least one article dispensing assembly and a support plate, each article dispensing assembly comprising:

i. a base, ii. a frame for enclosing a plurality of articles to be dispensed in a stack, iii. a hinge for hingedly mounting said frame onto said support plate for movement from a vertical position to a non-vertical position, iv. a gate behind said frame for receiving articles from said frame and allowing only one article at a time to pass through, v. a transport mechanism underneath said frame for transporting articles from said frame to said gate, vi. a locking mechanism for locking the frame in a vertical position, vii. an adjustable partition wall removably mounted in its frame for adjusting the inside area of the frame to snugly accommodate different sized articles, and viii. exit rollers for pulling articles out from said gates.

8. The apparatus of claim 7 wherein said exit rollers are behind said gates.

9. The apparatus of claim 8 wherein said cabinet has an opening in the front and the apparatus further includes an angled tray for receiving articles pulled out by the exit rollers and directing said articles to said opening in the front of the cabinet.

10. Apparatus for dispensing articles such as tickets, cards and the like comprising:

a. a cabinet having a front and a back, b. an article dispensing module inside said cabinet, said article dispensing module including at least one article dispensing assembly and a support plate, each article dispensing assembly comprising:

i. a base, ii. a frame for enclosing a plurality of articles to be dispensed in a stack, iii. a hinge for hingedly mounting said frame onto said support plate for pivotal movement-from a vertical position to a non-vertical position, iv. a gate for receiving an article from said frame and allowing only one article at a time to pass through, v. a transport mechanism for transporting articles from said frame to said gate, and vi. four sensor assemblies, one for sending out a signal used in counting articles dispensed, a pair of sensor assemblies for sending out signals for controlling movement of the transport mechanism, and a fourth sensor assembly for sending out a signal for indicating an empty condition in the frame, each sensor assembly including a flag and an optical sensor.

* * * * *